US005405103A

United States Patent [19]

Girardeau et al.

[11] Patent Number: 5,405,103

[45] Date of Patent: Apr. 11, 1995

[54] DEVICE FOR ACTUATING A MECHANICAL MEMBER, IN PARTICULAR FOR THE FORCE GUIDANCE OF A MISSILE, AND MISSILE EQUIPPED WITH SAID DEVICE

[75] Inventors: Jean-Louis Girardeau, Paris; Augustin Grossi, Montesson; Joël Farges, Arcueil; Patrick Fiandesio, Longjumeau, all of France

[73] Assignee: Societe Nationale Industrielle et Aerospatiale, Paris, France

[21] Appl. No.: 167,416

[22] Filed: Dec. 14, 1993

[30] Foreign Application Priority Data

Dec. 22, 1992 [FR] France ..... 92 15488

[51] Int. Cl.[6] ..... F42B 10/60; F42B 15/01

[52] U.S. Cl. ..... 244/3.22; 244/52

[58] Field of Search ..... 244/3.22, 52, 73 R; 60/228-232

[56] References Cited

U.S. PATENT DOCUMENTS

| | | | |
|---|---|---|---|
| 3,091,084 | 5/1963 | Eckhardt | 60/39.47 |
| 4,078,495 | 3/1978 | Ledden, Jr. | 102/49.3 |
| 4,712,747 | 12/1987 | Metz et al. | 244/3.22 |
| 4,964,592 | 10/1990 | Kranz | 244/3.22 |
| 5,028,014 | 4/1991 | Anderson, Jr. | 244/3.22 |
| 5,074,492 | 12/1991 | Morgand | 244/3.22 |

*Primary Examiner*—Ian J. Lobo

*Attorney, Agent, or Firm*—Marshall, O'Toole, Gerstein, Murray & Borun

[57] ABSTRACT

A device for actuating a movable mechanical member, using a fluid source such as a gas generator of a missile, of the type having a controllable distributor connected to the source. The device includes a body (11) provided with a distributor (12), the body being coupled, via an inlet orifice (17), to a fluid source; a first conduit (15) capable of connecting the inlet orifice to a chamber (16) of the distributor; an actuator cylinder (14) arranged in the body and including a first chamber (19A) and a second chamber (19B) which are coaxial and separated from each other by a sliding piston (31) connected to a rod (31B) which projects externally in relation to the body in order to be linked to a mechanical member. A second conduit (18) connects the chamber (16) of the distributor to the first chamber (19A) of the actuator cylinder, it being possible for the second conduit (18) to be brought into communication, via the chamber (16) of the distributor, either with the first conduit (15) or with an outlet orifice (20) outside the body, depending on the position of the distributor. A third conduit (21) connects the second chamber (19B) of the actuator cylinder to the inlet orifice (17) of the body.

11 Claims, 6 Drawing Sheets

FIG. 2
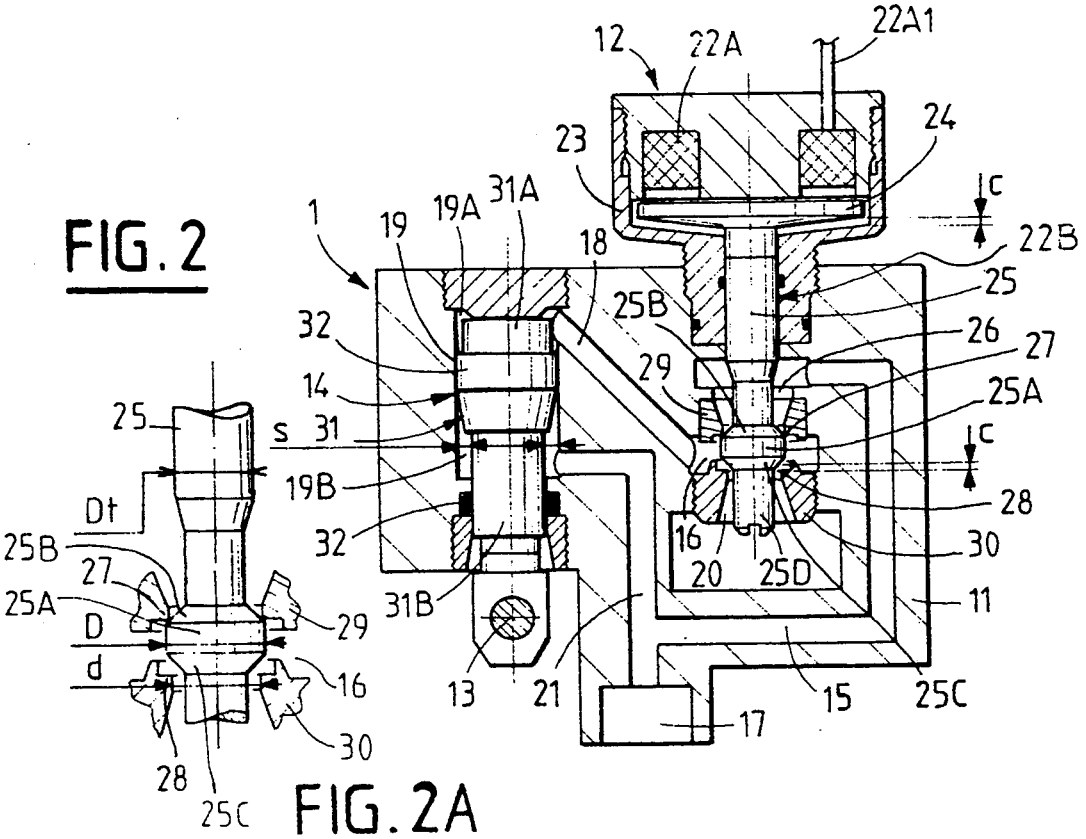
FIG. 2A
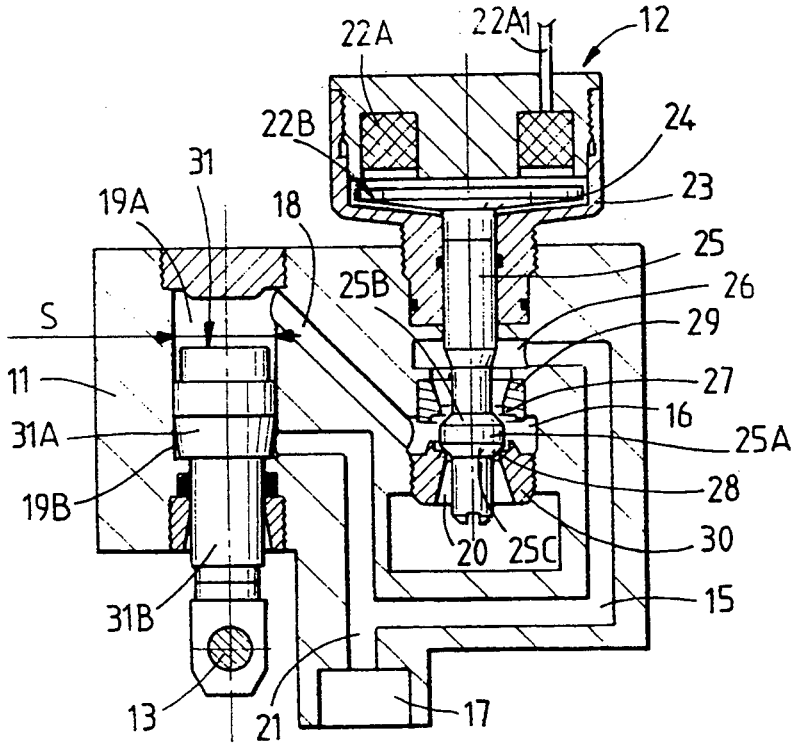
FIG. 3

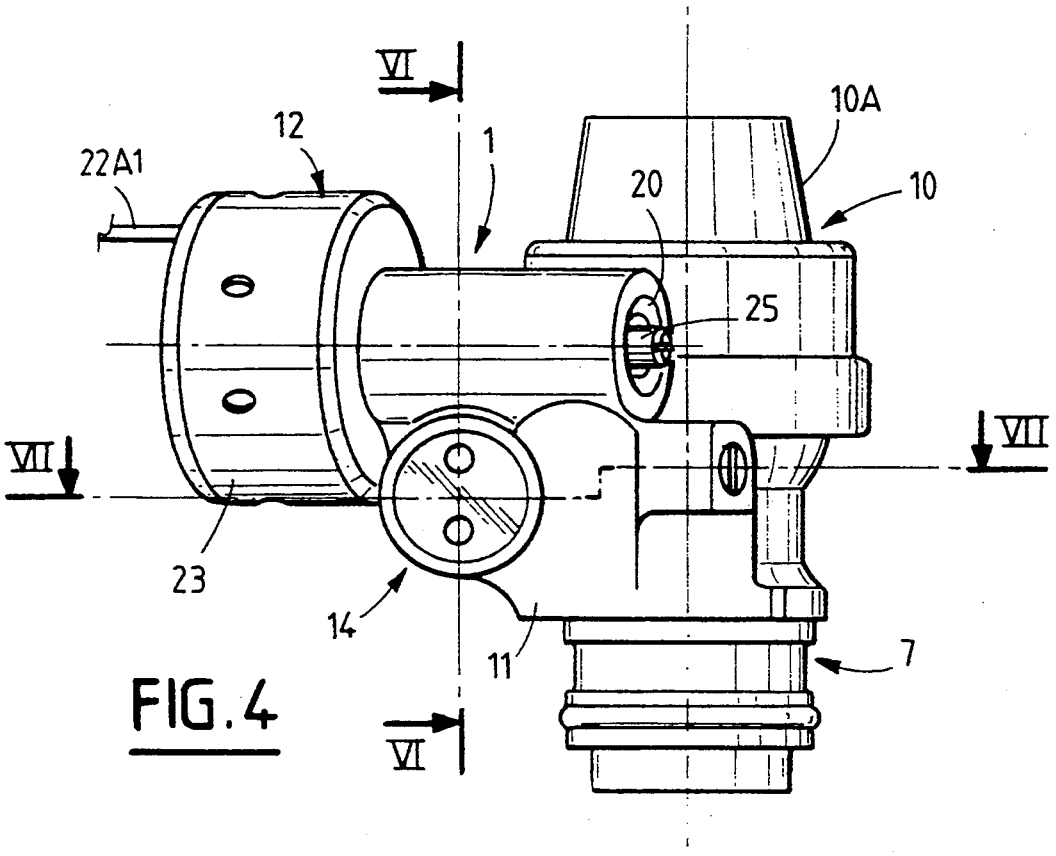
FIG. 4
FIG. 5
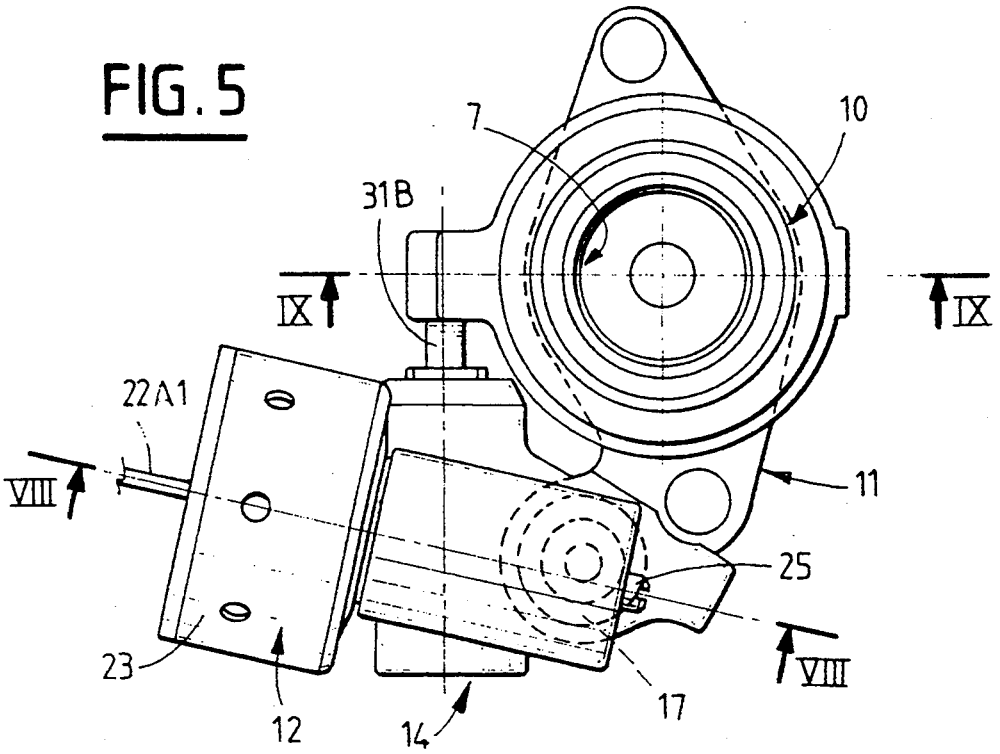

DEVICE FOR ACTUATING A MECHANICAL MEMBER, IN PARTICULAR FOR THE FORCE GUIDANCE OF A MISSILE, AND MISSILE EQUIPPED WITH SAID DEVICE

The present invention relates to a device for actuating a mechanical member using a fluid supply source.

The device according to the invention is more particularly, although not exclusively, intended for the guidance, in particular force guidance, of aircraft such as, for example, missiles.

BACKGROUND OF THE INVENTION

Indeed, it is known that, in order to abruptly alter the trajectory of a missile, a guidance unit is used comprising a plurality of lateral nozzles which are distributed around the structure of said missile and the flow of the gas jet of which may be deflected by a mechanical member linked to each lateral nozzle and controlled by an actuating device. The latter generally comprises a controllable distributor through which the gas jet coming from the main propulsion generator of the missile or from an auxiliary generator, and supplying the nozzles, can pass. The distributor acts, by means of the gas jet, on the mechanical member which enables, by its change in position, the gas jet originating from the corresponding lateral nozzle to be deflected in order thus to alter the trajectory of the missile.

Although these control devices are widely used for the force guidance of missiles, risks of malfunction may arise within the distributor and the member to be controlled because of the particularly harsh fluid medium to which they are subjected, due to the high pressure and to the high temperature of the gas jet expelled from the generator.

SUMMARY OF THE INVENTION

The object of the present invention is to remedy these drawbacks.

For this purpose, the device for actuating a mechanical member, using a fluid source such as, in particular, a gas generator of a missile, of the type having a controllable distributor connected to said fluid source, is remarkable, according to the invention, in that it comprises:

- a body in which said distributor is arranged and which is coupled, via an input orifice, to said fluid source.
- a first conduit capable of connecting said inlet orifice to a chamber of said controllable distributor;
- an actuator cylinder arranged in said body and including a first chamber and a second chamber which are coaxial and separated from each other by a head of a sliding piston, the rod of which projects externally in relation to said body in order to be linked to said mechanical member by linkage means;
- a second conduit connecting the chamber of said distributor to the first chamber of said actuator cylinder, it being possible for said second conduit to be brought into communication, by means of said chamber of the distributor, either with said first conduit or with an outlet orifice outside the body, depending on whether the distributor is active or inactive; and

- a third conduit connecting said second chamber of the actuator cylinder to said inlet orifice of said body.

Thus, when the distributor is active, blocking off, for example, the communication between the first conduit connected to the outlet orifice and said chamber of said distributor, the piston is in the retracted position for which said member occupies a first operating position, under the action of the fluid source acting in the second chamber of the actuator cylinder via the third conduit, which drains the first chamber of the actuator cylinder toward the outside via the second conduit, the chamber of said distributor and the outlet orifice of the body. On the other hand, when the distributor is inactive, in this case bringing the second conduit into communication with the first conduit, by means of the chamber of the distributor, the piston slides toward its expelled position for which said member occupies a second operating position, under the action of the fluid source acting in the first chamber of the actuator cylinder, which, in this case, drains the second chamber via the third conduit.

Consequently, the device according to the invention overcomes the aforementioned drawbacks, since it enables said chamber of the distributor to be only brought into communication with the gas jet sequentially, that is to say only when the member has to be actuated in order to deflect the flow of the gas jet expelled from the nozzle, and since it completely isolates the control member from the jet or from the gas flux emitted by the fluid source, such as the propulsion generator of the missile. In this case, the first position of said member, linked to one of the lateral nozzles of the missile, does not affect the trajectory of the missile since the gas jet does not pass through the chamber of the device and therefore does not act on the piston of the actuator cylinder, whereas the second position of said member enables the flow of the gas jet expelled from the nozzle to be deflected, thereby altering the trajectory of said missile.

Moreover, the design of said actuating device in the form of a body combining the actuator cylinder and the distributor thus constitutes one construction unit, facilitating its practical realization as well as the operations of mounting and of dismantling for the purpose of servicing it or replacing it.

Advantageously, the cross section of the first chamber of said actuator cylinder is greater than the annular cross section of the second chamber of the piston, defined by the difference in areas between the head and the rod of said piston. In that way, the difference in the sections of the piston in the two chambers enables, during the operation of the distributor, said piston to be expelled despite an identical pressure originating from the gas flux in the two chambers. Of course, seals are provided between said piston and said chambers and are produced in a material withstanding the high pressures and temperatures. By way of example, graphite seals are most particularly suitable for this type of application.

Furthermore, said means of linkage between said piston and said member may be constituted by at least one pin joint, ball joint or similar articulation, capable of causing the displacement of said member from a first position toward a second position, and vice versa, as a result of said piston sliding. Thus, the most appropriate articulation may be fitted to each type of member.

In a preferred embodiment, said distributor comprises a controllable electromagnet, connected to said body, and an axially displaceable element including a rod which passes through an axial passage made in said body and comprising said chamber, said rod having a collar located within said chamber of said axial passage and capable of interacting either with an upstream bearing surface of said passage, via which bearing surface said first conduit emerges, when said electromagnet is energized, or with a downstream bearing surface of said passage, emerging toward said outlet orifice of the body, when said electromagnet is de-energized. Thus, the contact of the collar of the rod with the upstream bearing surface or the downstream bearing surface of the passage blocks off, respectively, the first, supply conduit of said chamber of the distributor, the second, outflow conduit of the distributor being in communication with the outlet or exhaust orifice, or the outlet orifice of said chamber of the distributor, the first conduit being in communication with the second conduit.

Advantageously, the diameter of said collar is slightly greater than the internal diameters of the upstream and downstream bearing surfaces of said passage, whereas the diameter of said rod is slightly less than those of said bearing surfaces. These geometrical considerations enable a low-power electromagnet to be used since, in this case, a minimal force is necessary to displace the rod, which furthermore enables the overall size of said electromagnet to be reduced. More particularly, said collar has two conical surfaces capable of interacting respectively with the upstream and downstream bearing surfaces of said axial passage. Thus, the contact between the conical surfaces and the upstream and downstream bearing surfaces proves to be reliable and guarantees good sealing.

Preferably, said outlet orifice of said body is coaxial with said passage and extends the downstream bearing surface of said passage, and the rod is terminated, at its end opposite that facing the electromagnet, by a cylindrical endpiece, the diameter of which is close to the diameter of said rod and which is located in said outlet orifice. In this case, it is also advantageous if the outlet orifice of the body flares outward.

In a preferred embodiment, said upstream and downstream bearing surfaces are defined by rings which are fixed in said passage of the body and through which passes said sliding rod whose collar is provided between said rings. Thus, the constructional simplicity of said bearing surfaces, defined by rings, should be noted.

In order to filter the hot gas jet originating from the fluid source, such as the gas generator of a missile, said inlet orifice of the body is fitted with a sleeve fixed to said body and provided with an axial channel linked up with said fluid source and emerging laterally into external annular grooves communicating with each other and with said first and third conduits. This forced path for the gas jet thus "attenuates" its cleanness and temperature characteristics.

One specific application of this actuating device relates to the guiding, in particular force guidance, of a missile using gas jets expelled from the gas generator and capable of passing through lateral nozzles. Thus, an actuating device in communication with the gas flux may be advantageously linked to at least one nozzle, the actuating device being capable, when it is actuated, of controlling the orientation of a mechanical member linked to said nozzle, in order to alter the direction of flow of the gas jet expelled from said nozzle and, therefore, the trajectory of the missile.

BRIEF DESCRIPTION OF THE DRAWINGS

The figures of the appended drawing will clearly explain how the invention may be realized. In these figures, identical reference numbers designate similar elements.

FIG. 2 shows, in section, a diagrammatic embodiment of an actuating device according to the invention, in its inactive operating configuration.

FIG. 2A shows an enlargement of a detail of the device illustrated in FIG. 2.

FIG. 3 shows, in an analogous manner, the device of FIG. 2 in its active operating configuration.

FIGS. 4 and 5 illustrate outside views, in two perpendicular planes, of a specific embodiment of the actuating device, in the inactive configuration, for controlling an orientable nozzle skirt.

DESCRIPTION OF THE PREFERRED EMBODIMENT

Figure 1:
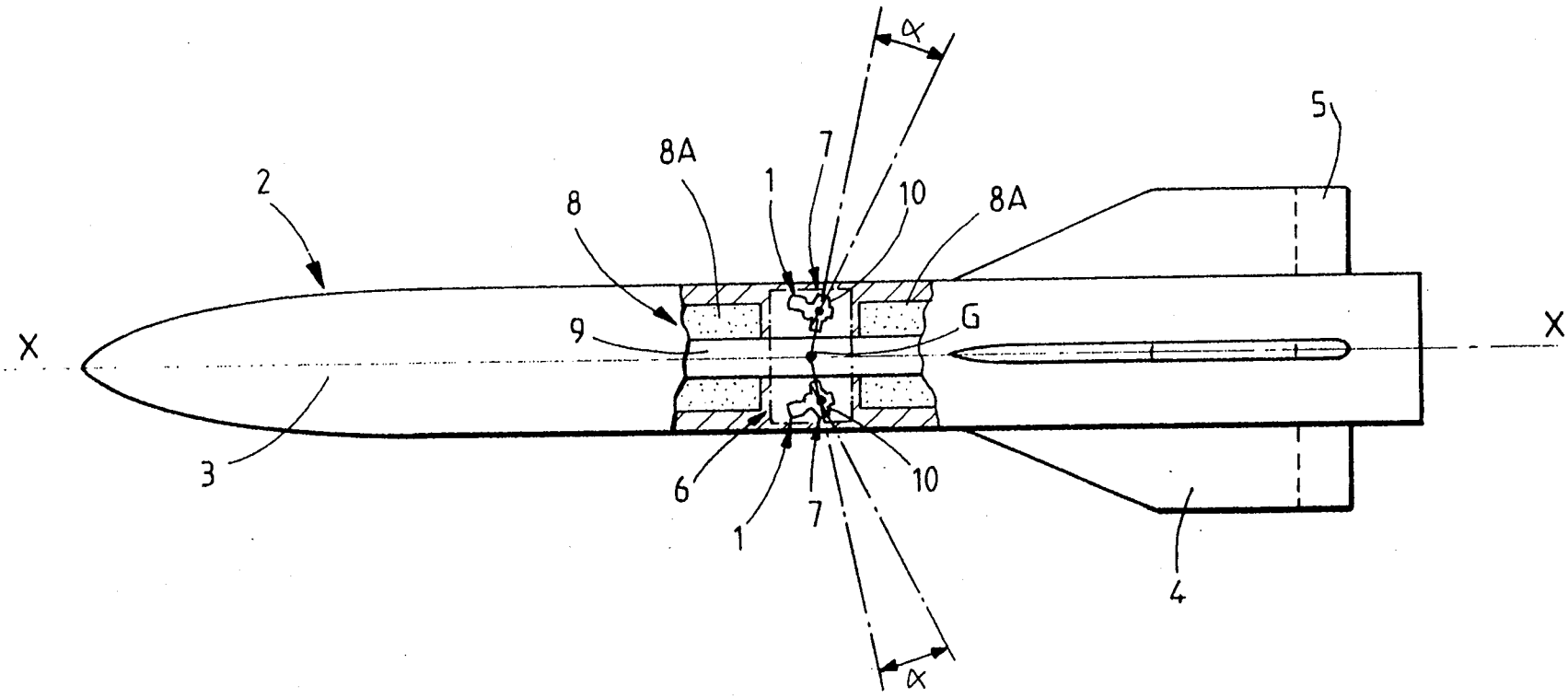
FIG. 1 illustrates diagrammatically, in partial longitudinal section, a missile equipped with actuating devices of the invention, for guiding it.

The actuating device 1 according to the invention will be described hereinbelow with regard to its preferential application relating to the force guidance of a missile 2 shown diagrammatically in FIG. 1.

This missile 2 comprises an elongate structure 3 of axis X—X and equipped, in the usual way, with fins 4 fitted with control surfaces 5. Provided in the structure 3 of the missile, in the vicinity of its center of gravity G, is a unit 6 for the force guidance of the missile, including lateral nozzles 7, these being, for example, four in number, in diametrically opposite pairs. In this embodiment, the guidance unit 6 is located between two combustion chambers 8A of a gas generator 8, preferably a solid-propellant gas generator. The lateral nozzles 7 are connected to the chambers of the generator via conduits 9 and each of these nozzles is advantageously controlled by an actuating device 1 in accordance with the invention. As will be seen in more detail subsequently, this device makes it possible, when it is commanded, to act on a mechanical member 10 with the purpose of deflecting the gas jet expelled from the lateral nozzle and coming from the combustion chambers of the gas generator, in order thereby to alter the trajectory of the missile.

The actuating device 1, shown diagrammatically in FIGS. 2 and 3, comprises a single body 11 which is intended, in this application, to be fixed to the structure 3 of the missile and in which are arranged, on the one hand, a control distributor 12 and, on the other hand, an actuator cylinder 14 for actuating said member to be displaced by articulation means 13.

Several conduits and orifices are made in the body. Firstly, a first conduit 15 connects a chamber 16 of the distributor 12 to an inlet orifice 17 of the body, which is in direct communication with the gas jet delivered by the gas generator. A second conduit 18 brings the chamber 16 of the distributor into communication with a first chamber 19A of the actuator cylinder 14. Depending on the state, inactive or active, of the distributor, this second conduit 18 may be in communication, by means of the chamber 16 of the distributor, with the first conduit 15 or with an outlet orifice 20 of the body, connecting with the surrounding outside medium. Finally, a third conduit 21 connects the second chamber 19B of the actuator cylinder to the inlet orifice 17 of the body.

More particularly, the distributor 12 is composed of a controllable electromagnet 22A, connected via a connection 22A1 to an electrical power supply, not shown, and of a displaceable element 22B axially extending the electromagnet. The latter is housed in a casing 23 which is coupled, by screwing, to said body 11. The displaceable element 22B is constituted, in a known way, by a disc 24, facing the electromagnet and housed in the bottom of the casing, and by a rod 25 rigidly attached to the disc 24 and passing through the bottom of the casing in order to emerge coaxially into a passage 26 which is provided in said body 11 and in which the chamber 16 of the distributor 12 is made. Advantageously, the rod 25 has, in the vicinity of its end opposite that screwed onto the disc, an annular collar 25A which is in this case located within the chamber 16 of said passage 26. The collar 25A is thus capable of interacting, depending on the sliding of the rod controlled by the electromagnet, either with an upstream bearing surface 27 of said passage, via which the first conduit 15 emerges, or with a downstream bearing surface 28 of said passage communicating with the outlet orifice 20 of the body. The chamber 16 of the distributor is then limited by the upstream and downstream bearing surfaces 27, 28 of the passage, whereas the second conduit 18 emerges laterally into said chamber, being in communication either with the first conduit 15 or with the outlet orifice 20.

Moreover, it should be noticed, more particularly in the enlargement of FIG. 2A, that the diameter Dt of the rod 25 is slightly less than the identical internal diameters d of the upstream 27 and downstream 28 bearing surfaces of the passage, and that the diameter D of said collar 25A is greater, but only slightly, than the identical internal diameters d of the upstream 27 and downstream 28 bearing surfaces of the passage 26, which bearing surfaces are defined, for example, by rings 29, 30 fixedly engaged in said passage. The rod 25 thus passes through the rings 29, 30 and the collar 25A is located between them. In addition, in order to ensure effective contact between the collar 25A and the bearing surfaces 27, 28 of said rings, conical surfaces 25B and 25C terminate the two sides of the collar, so that optimal sealing is obtained when one or other of the conical surfaces 25B and 25C bears, by the sliding of the rod, against the corresponding bearing surface. In this regard, c in the figures represents the displacement travel of the sliding element 25, and therefore of the collar of the rod between the rings, depending on whether or not the electromagnet is energized.

Furthermore, in this exemplary embodiment, the outlet orifice 20 is coaxial with the passage 26 of the distributor and it is advantageously defined by the downstream annular ring 30. In addition, the outlet orifice 20 flares outward. Additionally, the rod 25 is terminated by a cylindrical endpiece 25D extending the collar 25A, having a diameter close to, but less than, the latter. This endpiece 25D engages in the outlet orifice 20 of the body, defined by the downstream ring 30.

As regards the actuator cylinder 14, it comprises a piston 31 capable of sliding, sealingly, in the chambers 19A and 19B formed by a passage 19 made in the body. More particularly, the piston 31 is composed of a head 31A separating, in a sealed fashion, the two chambers 19A and 19B and of a rod 31B extending the head on the side facing the second chamber 19B and projecting externally in relation to the body 11, in order to be linked to the control member by linkage means 13, as will be seen subsequently. Nevertheless, it is pointed out that the rod 31B, and therefore the control member, are outside the gas jet and are consequently not in contact with the latter. Seals 32 are provided, on the one hand, around the head 31A of the piston and, on the other hand, around the rod 31B, and they are produced, by reason of the temperatures and pressures prevailing, with a strong material based on graphite. Moreover, it should be noticed in FIGS. 2 and 3 that the cross section S of the first chamber 19A in communication with the second conduit 18 is optimal, since it corresponds to the transverse area of the head 31A of the piston, and is greater than the cross section s of the second chamber 19B in communication with the third conduit 21, since it corresponds to the difference between the cross section of the head 31A and the cross section of the rod 31B.

Figure 6:
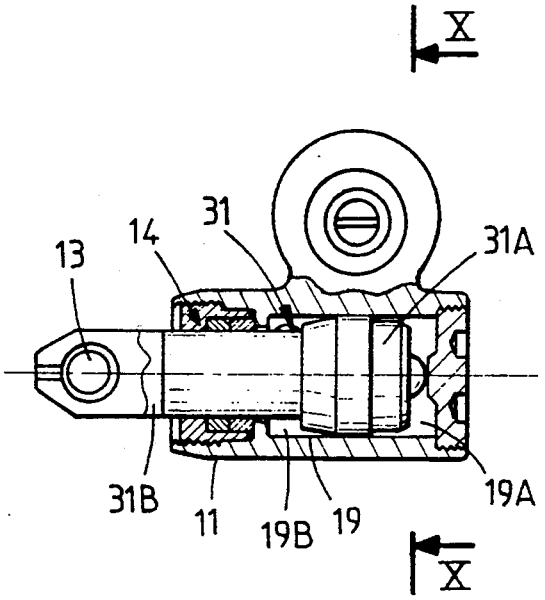
FIGS. 6 and 7 are respectively sectional views of the device along the lines VI—VI and VII—VII of FIG. 4.
Figure 7:
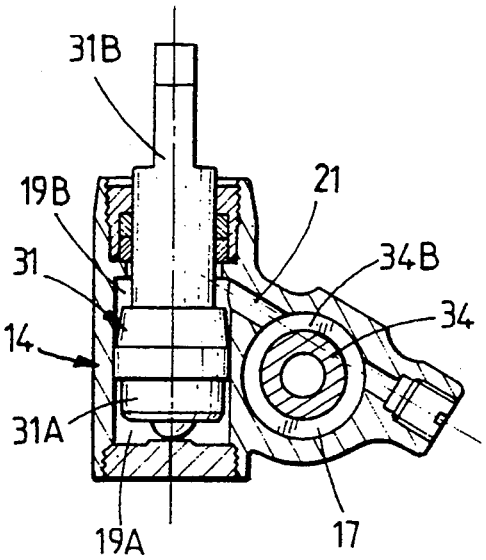

The diagrammatic representation of the actuating device 1, illustrated in FIGS. 2 and 3, advantageously enables the electromagnetic distributor 12, the actuator cylinder 14 and the various conduits and passages provided in the body 11 to be viewed in the same cutting plane. However, in the aforementioned exemplary application, the embodiment of the device 1 may look quite different, as may be seen in FIGS. 4 and 5 showing the outside contour of the actuating device 1, of which the distributor 12 and the actuator cylinder 14, arranged in the same single body 11, may be recognized, which device is linked to one of the lateral nozzles 7 of the force guidance unit 6 of the missile 2. Of course, the numerical references assigned to the various components of the device described in FIGS. 2 and 3 have been kept for the device described in FIGS. 6 to 10. Thus, encountered again, for example with regard to FIG. 6, are the piston 31 of the actuator cylinder 14, capable of sliding in the passage 19 of the body, with regard to FIG. 7, the third conduit 21 connecting the second chamber 19B of the actuator cylinder to said inlet orifice 17 of the gas jet, with regard to FIG. 8, the distributor 12 in section and the first conduit 15 connecting the chamber 16 to the inlet orifice 17, with regard to FIG. 9, the lateral nozzle 7 equipped with the member 10 to be displaced by means of the actuator cylinder 14 and, with regard to FIG. 10, the second conduit 18 bringing the chamber 16 of the distributor into communication with the first chamber 19A of the actuator cylinder.

Moreover, this specific embodiment of the actuating device 1 shows the member 10 to be moved by means of the actuator cylinder, as well as other specific details of the device which will be described hereinbelow.

Figure 9:
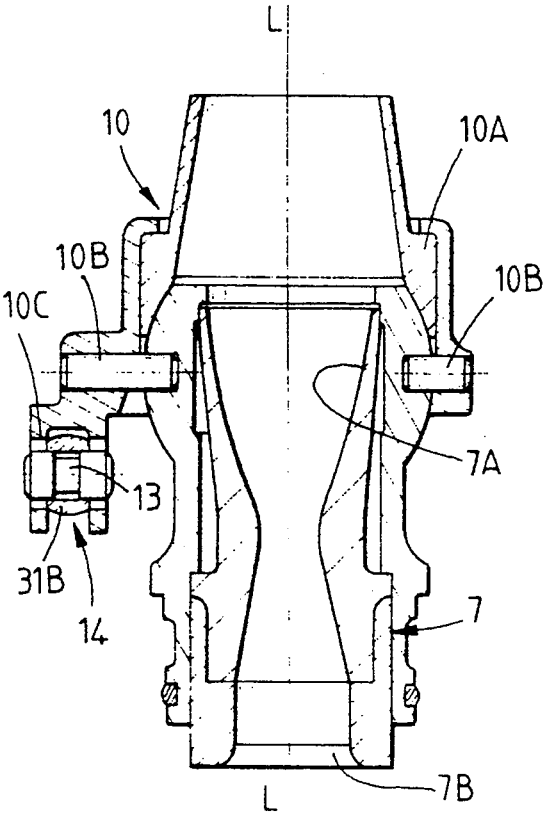

More particularly, the member 10, making it possible to deflect, if necessary, the gas jet coming from the generator and passing through the lateral nozzle 7, is defined, in this example, by a skirt 10A of substantially frustoconical shape, which surrounds the downstream end 7A of the nozzle in order to extend beyond the latter, its upstream end 7B communicating with the conduit 9. As FIG. 9 shows, the frustoconical skirt 10A is mounted so as to pivot in relation to the nozzle 7 about a pin 10B orthogonal to the longitudinal axis L—L of said nozzle. The skirt is furthermore provided with a foot in the form of a yoke 10C which straddles the terminal part of the rod 31B of said piston in order to be linked to it by the linkage means 13, which are defined by a pin parallel to the pivot pin 10B.

Figure 8:
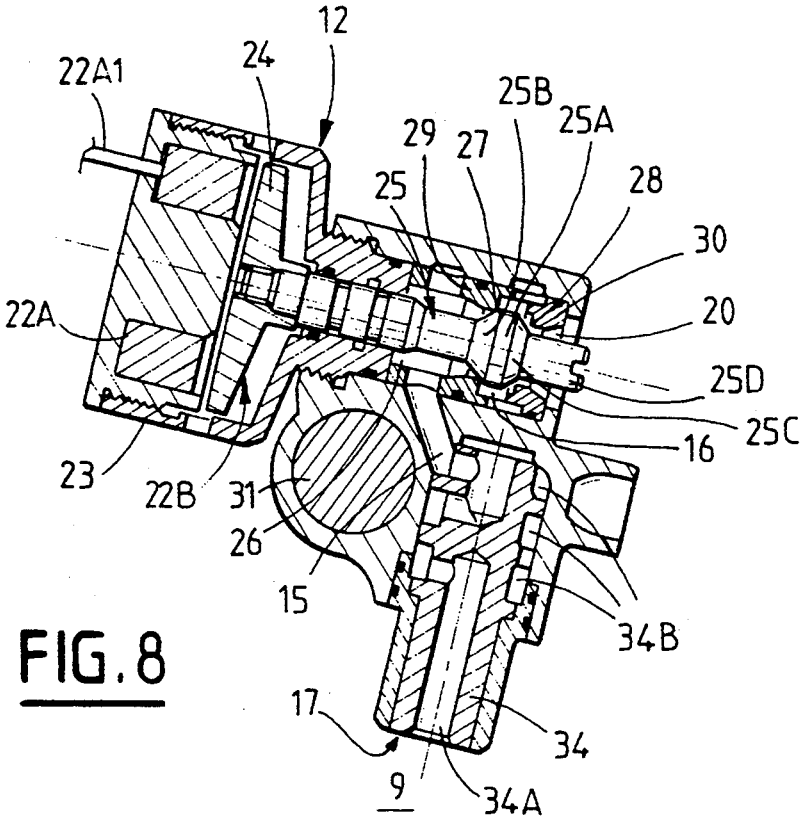
FIGS. 8 and 9 are respectively sectional views of the device along the lines VIII—VIII and IX—IX of FIG. 5.
Figure 10:
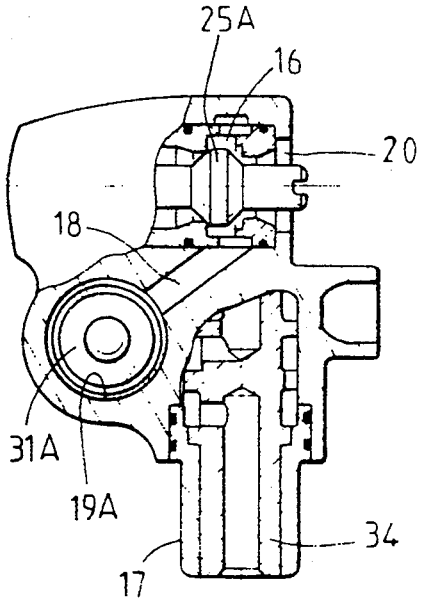
FIG. 10 is a section of the device along the line X—X of FIG. 6.

It should also be noticed in FIGS. 8 and 10 that the inlet orifice 17 of the gas jet is fitted with a cylindrical sleeve 34 fixedly held in the body and provided with an axial channel 34A linked up with the conduit 9 and emerging laterally into annular grooves 34B which are connected together in order to communicate thereafter with the first, supply conduit 15 of the distributor 12 and the third, supply conduit 21 of the second chamber 19B. The arrangement of this sleeve has the purpose of slowing down and cooling the gas jet generated by the generators in the direction of the force guidance unit 6 consisting of the actuating devices 1 and the lateral nozzles 7.

The operation of the actuating device 1 according to the invention takes place in the following manner. Firstly, each device 1 is assumed to be initially in the inactive configuration shown in FIGS. 2 and 4 to 10, for which configuration the trajectory of the missile 2 is not altered.

In this case, the electromagnet 22A is powered, by the connection 22A1, and attracts the movable element 22B toward it. In that way, the conical segment 25B of the collar 25A, provided on the rod 25 which is rigidly attached to the disc 24, is applied against the upstream bearing surface 27 of the ring 29, blocking off the passage 26 and, in particular, the communication between the first conduit 15 and the chamber 16 of the distributor. Consequently, the flow of the gas jet, passing through the channel 34A and the grooves 34B of the sleeve 34, and then the first conduit 15 in order to emerge into the passage 26, is stopped at the collar 25A/ring 29 contact. On the other hand, since the collar blocks off the upstream bearing surface 27, the chamber 16 of the distributor brings the first chamber 19A of the actuator cylinder into communication with the outside, respectively via the second conduit 18 and the outlet orifice 20 of the body. Simultaneously to the supply of the first conduit 15, the gas jet passes through the third conduit 21 so that the piston 31, under the action of the pressure being exerted on its surface s then prevailing in the second chamber 19B, is pushed back until it occupies a retracted position by the draining of the first chamber 19A in communication with the outside. Consequently, in the retracted position of the actuator cylinder 14, this position being obtained when the distributor 12 is powered, corresponds to a first, neutral position of the skirt 10A, in the axial extension of the lateral nozzle 7, which does not influence the trajectory of the missile. Thus it should be noticed that the orientable skirt 10A, the articulation means 13 and that part of the rod 31B which comes out of said body toward the outside medium are not affected by the gas jet emitted. Likewise, the chamber 16 of the distributor and the first chamber 19A of the actuator cylinder are isolated from the hot gas jet, preventing the risk of deformation or the like, as long as the electromagnetic distributor 12 is blocking off the first, supply conduit 15. Moreover, the small difference between the diameter Dt of the rod 25A and the diameter d of the upstream bearing surface 27 requires only a minimum force by the electromagnet, so that it is possible to have a small dimension and therefore a small space requirement.

When the flight of the missile 2 has to be suddenly altered, it is then necessary to operate at least one of the lateral nozzles 7 of the guidance unit 6 in order to obtain the desired change in orientation, and therefore in trajectory.

In order to do this, the electromagnet 22A of the distributor 11 is no longer powered by the connection 22A1. This break in power instantaneously causes a natural away movement of the displaceable element 22B which is no longer attracted by the electromagnet, by virtue of the gas Jet being expelled from the first conduit 15 toward the passage 26. In that way, the rod 25 is pushed back until the conical surface 25C of the collar 25A ends up being applied against the downstream bearing surface 28 of the ring 30. The displacement of the rod 25 over the travel c then establishes the fluid communication between the first conduit 15 and the second conduit 18 via the chamber 16 of the distributor, since the conical surface 25B of the collar has moved away, by the travel c, from the upstream bearing surface 27 of the ring 29. Simultaneously, the contact between the conical surface 29C of the collar and the downstream bearing surface 28 of the ring blocks off the outlet or exhaust orifice 20 of the distributor and thus cuts off the communication between the second conduit 18 and the distributor.

At this moment, the gas jet, after having passed through the first conduit 15, the chamber 16 and the second conduit 18, penetrates into the first chamber 19A of the actuator cylinder 14, so that the pressure of the gas jet is established in both chambers 19A and 19B via the respective conduits 18 and 21. Moreover, since the cross section S of the piston 31, defined by its head 31A in the first chamber 19A, is greater than that s in the second chamber 19B, the piston 31 slides in the passage 19 toward its expelled position, so that its rod 31B causes, by means of the articulation 13, the pivoting, in this case, of the orientable skirt 10A of the lateral nozzle 7 about the pin 10B.

Figure 13:
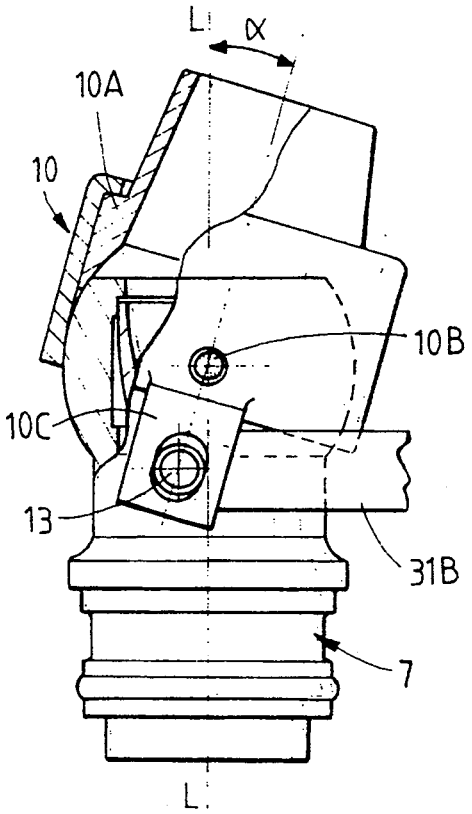
FIG. 13 is a side view of FIG. 9, showing the orientation of the skirt of the nozzle, as a result of the actuation of the device.
Figure 11:
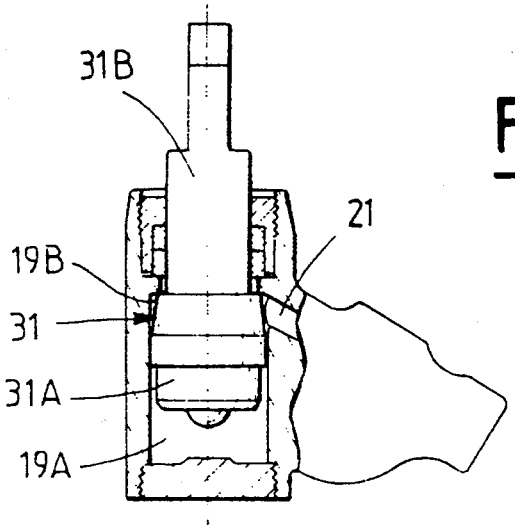
FIGS. 11 and 12 are views analogous to those of FIGS. 7 and 8, in the active configuration of said device.
Figure 12:
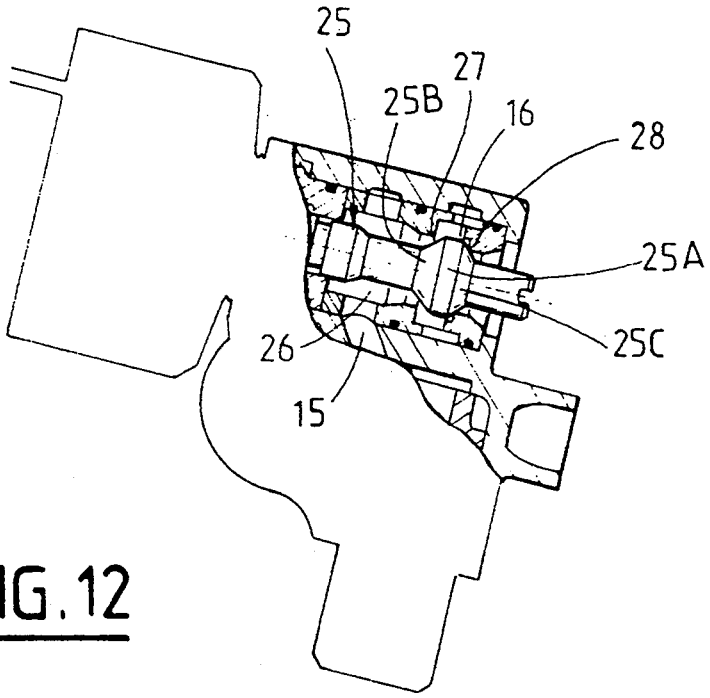

The device 1 then occupies its active configuration shown in FIGS. 3, 11 and 12, for which the control member, such as the skirt 10A, is then in a second position, deflected through an angle $\alpha$ in relation to the axis L—L of the lateral nozzle 7, as FIGS. 1 and 13 show, which enables the trajectory of the missile 1 to be thus altered.

It should thus be noticed that, by virtue of the actuating device of the invention, the flow of the hot gas jet in the device only takes place in a sequential manner, during the phases of flight of the missile requiring sudden alterations to its trajectory, and that the force for controlling the sliding element by the electromagnet is extremely small due to the close diameters between the rod and the bearing surfaces and is necessary only in a single displacement direction, toward the downstream bearing surface of the distributor. Moreover, the construction in a single body, combining the actuator cylinder and the distributor, results in a significant saving in space requirement. Of course, it goes without saying that the control member could be different and be presented, for example, in the form of another type of nozzle, an aileron, a control surface and the like.

It is claimed:

1. A device for actuating a movable mechanical member, using a gas generator, said device comprising:

a controllable distributor connected to said gas generator and including a chamber;

a body in which said distributor is arranged, said body being coupled, via an inlet orifice, to said gas generator;

a first conduit capable of connecting said inlet orifice to said chamber of said controllable distributor;

an actuator cylinder arranged in said body, said cylinder including a first chamber and a second chamber which are coaxial and separated from each other by a head of a sliding piston provided with a rod which projects externally in relation to said body in order to be linked to said mechanical member by linkage means;

a second conduit connecting said chamber of said distributor to the first chamber of said actuator cylinder, it being possible for said second conduit to be brought into communication, by means of said chamber of the distributor, either with said first conduit or with an outlet orifice outside the body, depending on whether the distributor is active or inactive; and a third conduit connecting said second chamber of the actuator cylinder to said inlet orifice of said body.

2. The device as claimed in claim 1, wherein the cross section of the first chamber of said actuator cylinder is greater than the annular cross section of the second chamber, defined by the difference in areas between the head and the rod of said piston.

3. The device as claimed in claim 1, wherein seals are provided between said piston and said chambers, said seals being made of a material capable of withstanding high pressures and temperatures.

4. The device as claimed in claim 1, wherein said means of linkage between said piston and said member are constituted by at least one pin joint, ball joint or similar articulation, capable of causing the displacement of said member from a first position toward a second position, and vice versa, as a result of said piston sliding.

5. The device as claimed in claim 1, wherein said distributor comprises a controllable electromagnet, connected to said body, and an axially displaceable element including a rod which passes through an axial passage made in said body and comprising said chamber, said rod having a collar located within said chamber of said axial passage and capable of interacting either with an upstream bearing surface of said passage, via which bearing surface said first conduit emerges, when said electromagnet is energized, or with a downstream bearing surface of said passage, emerging toward said outlet orifice of the body, when said electromagnet is deenergized.

6. The device as claimed in claim 5, wherein the diameter of said collar is slightly greater than the internal diameters of the upstream and downstream bearing surfaces of said passage, whereas the diameter of said rod is slightly less than those of said bearing surfaces.

7. The device as claimed in claim 5, wherein said collar has two conical surfaces capable of interacting respectively with the upstream and downstream bearing surfaces of said axial passage.

8. The device as claimed in claim 5, wherein said outlet orifice of said body is coaxial with said passage and extends the downstream bearing surface of said passage, and wherein the rod is terminated, at its end opposite that facing the electromagnet, by a cylindrical endpiece, the diameter of which is close to the diameter of said rod and which is located in said outlet orifice.

9. The device as claimed in claim 8, wherein said outlet orifice of the body flares outward.

10. The device as claimed in claim 1, wherein said upstream and downstream bearing surfaces are defined by rings which are fixed in said passage of the body and through which passes said sliding rod whose collar is provided between said rings.

11. The device as claimed in claim 1, wherein said inlet orifice of the body is fitted with a sleeve fixed to said body and provided with an axial channel linked up with said fluid source and emerging laterally into external annular grooves communicating with each other and with said first and third conduits.

* * * * *

UNITED STATES PATENT AND TRADEMARK OFFICE

CERTIFICATE OF CORRECTION

PATENT NO. : 5,405,103

DATED : April 11, 1995

INVENTOR(S) : Girardeau et al.

It is certified that error appears in the above-identified patent and that said Letters Patent is hereby corrected as shown below:

On the title page, after "Assignee," "Societe Nationale Industrielle et Aerospatiale" should be --Aerospatiale Societe Nationale Industrielle--

Signed and Sealed this

Third Day of October, 1995

*Attest:*

*Attesting Officer*

BRUCE LEHMAN

*Commissioner of Patents and Trademarks*